US011653714B2

(12) United States Patent
Chambers et al.

(10) Patent No.: US 11,653,714 B2
(45) **Date of Patent: *May 23, 2023**

(54) FOOTWEAR SOLE PLATE WITH NON-PARALLEL WAVES OF VARYING THICKNESS

(71) Applicant: NIKE, Inc., Beaverton, OR (US)

(72) Inventors: Clayton Chambers, Portland, OR (US); John Droege, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 24 days.

This patent is subject to a terminal disclaimer.

(21) Appl. No.: 17/372,760

(22) Filed: Jul. 12, 2021

(65) Prior Publication Data

US 2021/0337925 A1 Nov. 4, 2021

Related U.S. Application Data

(63) Continuation of application No. 16/395,589, filed on Apr. 26, 2019, now Pat. No. 11,089,834.

(Continued)

(51) Int. Cl.
*A43B 13/12* (2006.01)
*A43B 13/18* (2006.01)

(Continued)

(52) U.S. Cl.
CPC ..... *A43B 13/186* (2013.01); *A43B 13/125* (2013.01); *A43B 13/127* (2013.01);

(Continued)

(58) Field of Classification Search
CPC ..... A43B 7/141; A43B 13/125; A43B 13/127; A43B 13/183

(Continued)

(56) References Cited

U.S. PATENT DOCUMENTS 2,124,819 A * 7/1938 Halloran ..... A43B 13/42 36/76 R
2,713,732 A * 7/1955 Guest ..... A43B 7/14 36/167

(Continued)

FOREIGN PATENT DOCUMENTS

CN 2375297 Y 4/2000
CN 205728368 U 11/2016

(Continued)

*Primary Examiner* — Sharon M Prange
(74) *Attorney, Agent, or Firm* — Quinn IP Law

(57) ABSTRACT

A sole structure for an article of footwear has a sole plate that may include a midfoot region, and also may include a forefoot region or a heel region. The sole plate may have a foot-facing surface with ridges extending longitudinally in the midfoot region and in the forefoot region or heel region. The sole plate may have a ground-facing surface with grooves extending longitudinally in correspondence with the ridges. A thickness of the sole plate from the foot-facing surface to the ground-facing surface may vary at a transverse cross-section of the sole plate through the ridges, or along a length of at least one of the ridges, or at both the transverse cross-section and along the length of the at least one of the ridges. The ridges may have crests at least some of which may extend non-parallel with one another in a longitudinal direction of the sole plate.

20 Claims, 9 Drawing Sheets

Related U.S. Application Data

(60) Provisional application No. 62/678,503, filed on May 31, 2018.

(51) Int. Cl.
*A43B 13/14* (2006.01)
*A43B 21/26* (2006.01)
*A43B 21/32* (2006.01)

(52) U.S. Cl.
CPC ..... *A43B 13/146* (2013.01); *A43B 21/26* (2013.01); *A43B 21/32* (2013.01)

(58) Field of Classification Search
USPC ..... 36/76 C, 76 R, 107, 108
See application file for complete search history.

(56) References Cited

U.S. PATENT DOCUMENTS

| | | | | |
|---|---|---|---|---|
| 4,439,937 | A * | 4/1984 | Daswick | A43B 13/10 36/72 A |
| 6,023,861 | A * | 2/2000 | Bizzotto | A43B 13/12 36/179 |
| 2008/0229617 | A1 * | 9/2008 | Johnson | A43B 3/0057 36/102 |
| 2017/0035143 | A1 * | 2/2017 | Sato | A43B 7/148 |
| 2017/0095033 | A1 * | 4/2017 | Farina | A43B 13/026 |
| 2017/0095034 | A1 * | 4/2017 | Dupre | A43B 7/1445 |
| 2018/0125148 | A1 * | 5/2018 | Elder | A43B 13/122 |
| 2018/0132564 | A1 * | 5/2018 | Bruce | A43B 13/189 |
| 2018/0338568 | A1 * | 11/2018 | Chambers | A43B 13/141 |
| 2019/0261737 | A1 * | 8/2019 | Walsh | A43B 13/18 |
| 2019/0365030 | A1 * | 12/2019 | Chambers | A43B 3/0036 |
| 2020/0100565 | A1 * | 4/2020 | Yoshida | A43B 13/026 |

FOREIGN PATENT DOCUMENTS

| | | | |
|---|---|---|---|
| JP | 2003339405 | A | 12/2003 |
| KR | 100647108 | B1 | 11/2006 |
| WO | 9934972 | A1 | 7/1999 |

* cited by examiner

FOOTWEAR SOLE PLATE WITH NON-PARALLEL WAVES OF VARYING THICKNESS

CROSS-REFERENCE TO RELATED APPLICATIONS

This application is a continuation of U.S. Nonprovisional application Ser. No. 16/395,589, filed Apr. 26, 2019, which claims the benefit of priority to U.S. Provisional Application No. 62/678,503, filed May 31, 2018, and both of which are incorporated by reference in their entirety.

TECHNICAL FIELD

The present teachings generally include a sole plate for an article of footwear.

BACKGROUND

Footwear typically includes a sole structure configured to be located under a wearer's foot to space the foot away from the ground. Sole structures may typically be configured to provide one or more of cushioning, motion control, and resiliency.

DESCRIPTION

Figure 1:
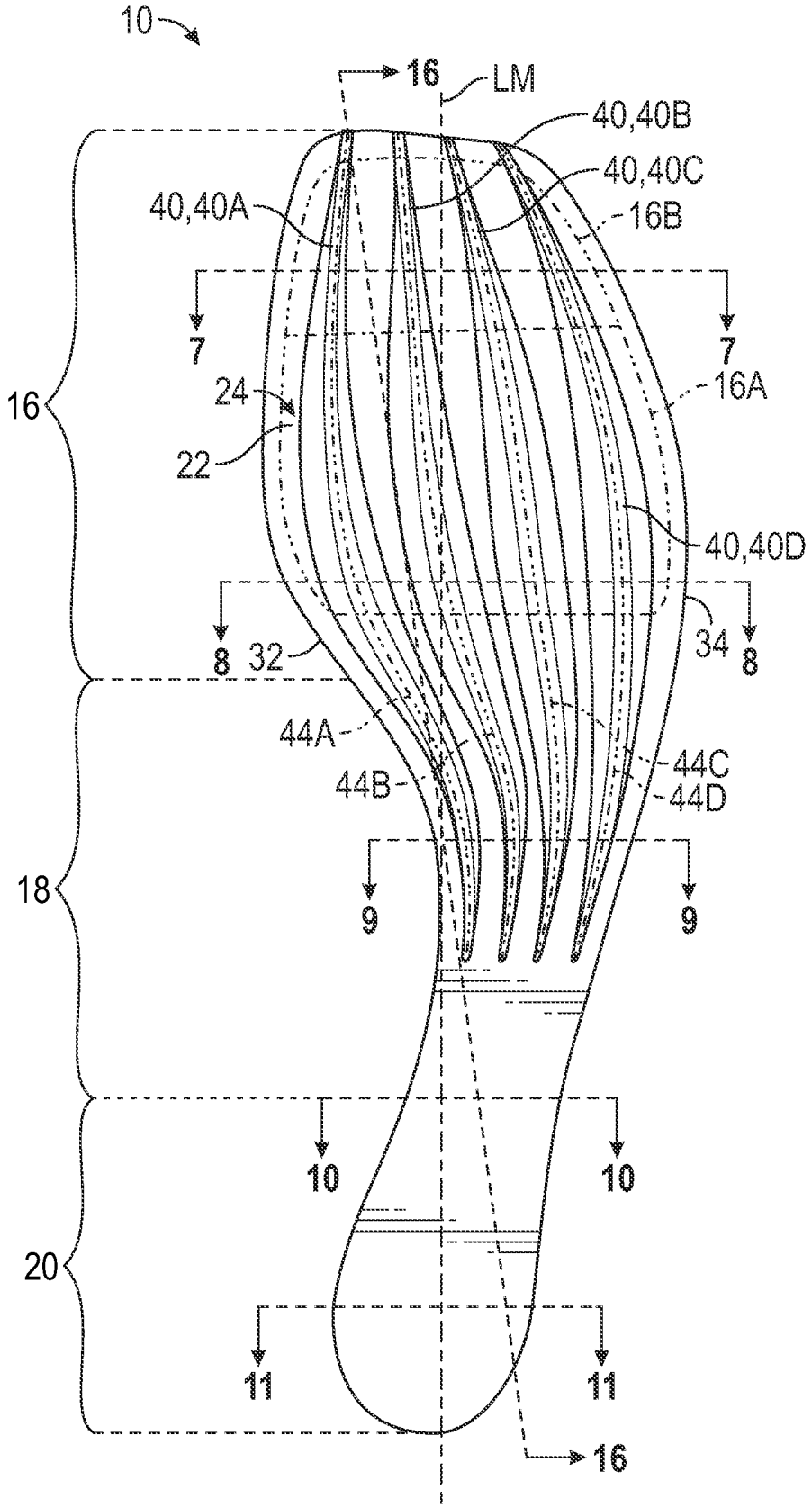
FIG. 1 is a schematic illustration in plan view of a foot-facing surface of a sole plate.

A sole plate is provided that is tuned for stiffness, energy absorption, and direction of energy return with any or all of a varying thickness, non-parallel, longitudinally-extending ridges, and a generally spoon-shaped forefoot portion. More particularly, a sole structure for an article of footwear comprises a sole plate that may include a midfoot region, and at least one of a forefoot region or a heel region. The sole plate may have a foot-facing surface with ridges extending longitudinally in the midfoot region and in the at least one of a forefoot region or a heel region. The sole plate may have a ground-facing surface with grooves extending longitudinally in correspondence with the ridges. The ridges and the grooves may be configured such that a thickness of the sole plate from the foot-facing surface to the ground-facing surface varies at a transverse cross-section of the sole plate through the ridges, or varies along a length of at least one of the ridges, or varies at both the transverse cross-section and along the length of the at least one of the ridges. The ridges, grooves, and a varied thickness as described may tune the stiffness and energy absorption of the sole plate for different zones while permitting a unitary, one-piece component of uniform material. The plate may function as a stiffness modifier within the sole structure.

In one or more embodiments, the ridges may have crests, and at least some of the crests may extend non-parallel with one another in a longitudinal direction of the sole plate. The grooves may also have crests, and at least some of the crests of the grooves may extend non-parallel with one another in the longitudinal direction.

In one or more embodiments, the sole plate may include both the forefoot region and the heel region. The ridges and the grooves may extend only in the midfoot region and the forefoot region, and the sole plate may have an undulating profile at any transverse cross-section of the sole plate through the ridges. In one or more of such embodiments, the transverse cross-section may be a first transverse cross-section of the sole plate in the midfoot region, and the undulating profile of the sole plate at the first transverse cross-section may include a first set of multiple waves having crests at the ridges and having troughs between respective adjacent ones of the ridges. The undulating profile of the sole plate at a second transverse cross-section in the forefoot region may include a second set of multiple waves having crests at the ridges and having troughs between respective adjacent ones of the ridges. Waves of the first set may each have a first wavelength, and waves of the second set may each have a second wavelength greater than the first wavelength.

In one or more embodiments, a lateral-most one of the ridges may curve in the longitudinal direction to follow a curved lateral edge of the sole plate, and a medial-most one of the ridges may curve in the longitudinal direction to follow a curved medial edge of the sole plate. Because the ridges may be non-parallel, the wavelengths can be different at the different transverse cross-sections. Generally, ridges with shorter wavelengths are stiffer in compression than ridges with longer wavelengths.

In one or more embodiments, the amplitude of the crests of the ridges may be greater in a zone of the sole plate configured for relatively high compressive loads than in a zone of the sole plate configured for relatively low compressive loads. For example, at least some of the crests may have an amplitude in a rearward portion of the forefoot region that is greater than in a forward portion of the forefoot region and than in the midfoot region. The rearward portion may be configured to underlie the metatarsal-phalangeal joints of a wearer, thus increasing stiffness and energy-absorbing capability where loading is greatest.

In one or more embodiments, the sole plate may be a resilient material such that the crests of the ridges may decrease in elevation from a steady state elevation to a loaded elevation under a dynamic compressive load and may return to the steady state elevation upon removal of the dynamic compressive load. For example, the sole plate may be one of a fiber strand-lain composite, a carbon-fiber composite, a thermoplastic elastomer, a glass-reinforced nylon, wood, or steel. The sole plate may resiliently deform to absorb and return energy. The areas of greater amplitude can absorb more energy than those of less amplitude. When sandwiched between foam layers of less compressive stiffness, such as a resilient foam midsole layer overlying and underlying the sole plate, the foam layers may react against the sole plate when resiliently deforming, so that the sole plate acts as a moderator both of bending stiffness and compressive stiffness of the sole structure.

In one or more embodiments, the foot-facing surface may be concave in a longitudinal direction of the sole plate in a forefoot region of the sole plate, and the ground-facing surface may be convex in the longitudinal direction of the sole plate in the forefoot region, creating a spoon-shaped forefoot region. In one or more embodiments, the sole plate may also have a heel region, and the sole plate may slope in the longitudinal direction in the midfoot region from the heel region to the forefoot region. The sole plate may be biased to this spoon shape in the forefoot region. Bending of the sole plate in the longitudinal direction during dorsiflexion may store energy that is released after toe-off, with the sole plate unbending to its original biased, spoon shape at least partially in the direction of forward motion.

In one or more embodiments, the foot-facing surface may have an undulating profile at the transverse cross-section that may include multiple waves having crests at the ridges and having troughs between respective adjacent ones of the ridges. The crests at the ridges may be aligned with crests of the grooves. The thickness of the sole plate at the transverse cross-section may be less at the crests of the ridges than between the crests of the ridges and the troughs.

In one or more embodiments, the ground-facing surface may be flat between the grooves at the transverse cross-section.

In one or more embodiments, the sole plate may include both the forefoot region and the heel region, and may be a unitary, one-piece component.

In an aspect of the disclosure, a sole structure for an article of footwear may comprise a sole plate including a midfoot region, a forefoot region, and a heel region. The sole plate may have a foot-facing surface with ridges extending longitudinally such that the foot-facing surface may have an undulating profile at a transverse cross-section of the sole plate through the ridges. The sole plate may have a ground-facing surface with grooves extending longitudinally. At least some of the ridges of the foot-facing surface may extend non-parallel with one another, and at least some of the grooves of the ground-facing surface may extend non-parallel with one another in correspondence with the ridges. The ridges and the grooves may be configured such that a thickness of the sole plate from the foot-facing surface to the ground-facing surface varies at the transverse cross-section, or varies along a length of at least one of the ridges, or varies at both the transverse cross-section and along the length of the at least one of the ridges. At least some of the ridges may vary in amplitude in a longitudinal direction of the sole plate.

In one or more embodiments, the amplitude of at least some of the ridges may be greater in a rearward portion of the forefoot region than in a forward portion of the forefoot region, and greater in the rearward portion of the forefoot region than in the midfoot region.

In one or more embodiments, the ridges may have crests, and the sole plate may be a resilient material such that the crests of the ridges may decrease in elevation from a steady state elevation to a loaded elevation under a dynamic compressive load and may return to the steady state elevation upon removal of the dynamic compressive load.

In one or more embodiments, the transverse cross-section may be a first transverse cross-section of the sole plate in the midfoot region, and the undulating profile of the sole plate at the first transverse cross-section may include a first set of multiple waves having crests at the ridges and having troughs between respective adjacent ones of the ridges. The undulating profile of the sole plate at a second transverse cross-section in the forefoot region may include a second set of multiple waves having crests at the ridges and having troughs between respective adjacent ones of the ridges. Waves of the first set may each have a first wavelength. Waves of the second set may each have a second wavelength greater than the first wavelength. A lateral-most one of the ridges may curve in the longitudinal direction to follow a curved lateral edge of the sole plate. A medial-most one of the ridges may curve in the longitudinal direction to follow a curved medial edge of the sole plate.

In one or more embodiments, the foot-facing surface may be concave in the longitudinal direction in the forefoot region. The ground-facing surface may be convex in the longitudinal direction in the forefoot region. The sole plate may slope in the longitudinal direction in the midfoot region from the heel region to the forefoot region, and the ground-facing surface may be flat between the grooves at the transverse cross-section.

The above features and advantages and other features and advantages of the present teachings are readily apparent from the following detailed description of the modes for carrying out the present teachings when taken in connection with the accompanying drawings.

Figure 10:
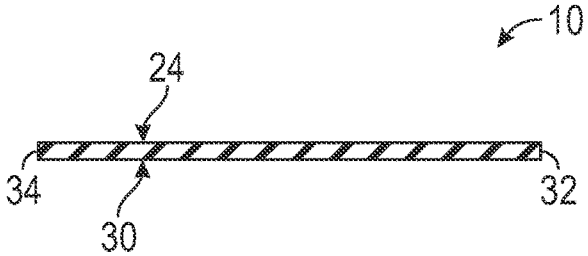
FIG. 10 is a schematic cross-sectional illustration of the sole plate of FIG. 1 taken at lines 10-10 in FIG. 1.

Referring to the drawings, wherein like reference numbers refer to like components throughout the views, FIG. 1 shows an embodiment of a sole plate 10 for an article of footwear 12, such as the article of footwear 12 of FIG. 10. More specifically, the sole plate 10 is included in a sole structure 14 of the article of footwear 12. The sole plate 10 described herein is configured to moderate bending stiffness during dorsiflexion, and direct return energy to the foot at least partially in a forward direction when dynamic compressive loading is removed following dorsiflexion during a stride. More specifically, the sole plate 10 has varying, non-parallel ridges and grooves, and a general spoon shape, and resiliently deforms when under a dynamic load, storing elastic energy, and resiliently returns to an unloaded state when the dynamic load is removed, releasing the stored elastic energy.

As used herein, the term "plate", such as in sole plate 10, refers to a member of a sole structure that has a width greater than its thickness and is generally horizontally disposed when assembled in an article of footwear that is resting on the sole structure on a level ground surface, so that its thickness is generally in the vertical direction and its width is generally in the horizontal direction. A plate need not be a single component but instead can be multiple interconnected components. Portions of a plate can be flat, and portions can have some amount of curvature and variations in thickness when molded or otherwise formed in order to provide a shaped footbed and/or increased thickness for reinforcement in desired areas.

With reference to FIG. 1, the sole plate 10 has a forefoot region 16, a midfoot region 18, and a heel region 20, and as such is referred to as a full-length sole plate 10 and is a unitary, one-piece component. Alternatively, in other embodiments within the scope of the present teachings, the sole plate 10 could include only a forefoot region 16 and midfoot region 18, or only a midfoot region 18 and heel region 20.

When a human foot 26 of a size corresponding with the sole structure 14 (see FIG. 13) is supported on the sole structure, the forefoot region 16 generally includes portions of the sole plate 10 corresponding with the toes and the joints connecting the metatarsals with the phalanges of the foot 26 (interchangeably referred to herein as the "metatarsal-phalangeal joints" or "MPJ" joints). The midfoot region 18 generally includes portions of the sole plate 10 corresponding with an arch area of the human foot, including the navicular joint. The heel region 20 generally includes portions of a sole plate corresponding with rear portions of the foot 26, including the calcaneus bone. The forefoot region 16, the midfoot region 18, and the heel region 20 may also be referred to as a forefoot portion, a midfoot portion, and a heel portion, respectively, and may also be used to refer to corresponding regions of an upper 23 shown in FIG. 12 and other components of the article of footwear 12. The midfoot region 18 is disposed between the forefoot region 16 and the heel region 20 such that the forefoot region 16 is forward of (i.e., anterior to) the midfoot region 18 and the heel region is rearward of (i.e., posterior to) the midfoot region 18.

Figure 2:
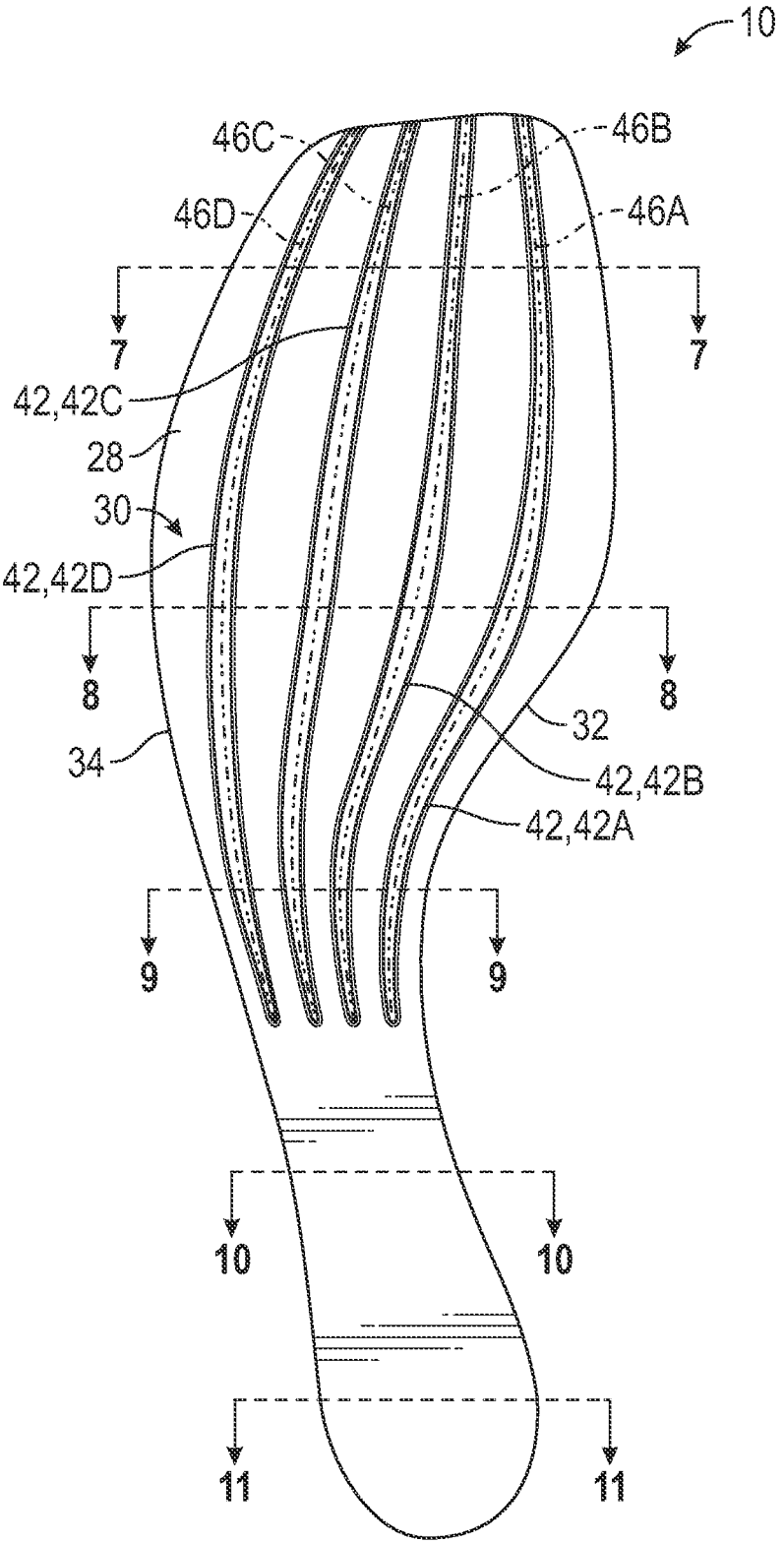
FIG. 2 is a schematic illustration in plan view of a ground-facing surface of the sole plate of FIG. 1.

The sole plate 10 has a first side 22 shown in FIG. 1, also referred to as a foot-facing side 22 that includes a foot-facing surface 24. As shown in FIG. 2, the sole plate 10 also has a second side 28 referred to as a ground-facing side 28 that includes a ground-facing surface 30. The foot-facing side 22 is closer to the foot 26 (shown in phantom in FIG. 16) than is the ground-facing side 28 when the sole plate 10 is assembled in the article of footwear 12 and worn on a foot 26. The foot-facing side 22 is above the ground-facing side 28 when the sole plate 10 is assembled in the article of footwear 12 and worn on the foot 26. The sole plate 10 also has a curved lateral edge 34 and a curved medial edge 32. The sole plate 10 is a sole plate for a right foot. It should be understood that a sole plate for a left foot is a mirror image of the sole plate 10.

Figure 7:
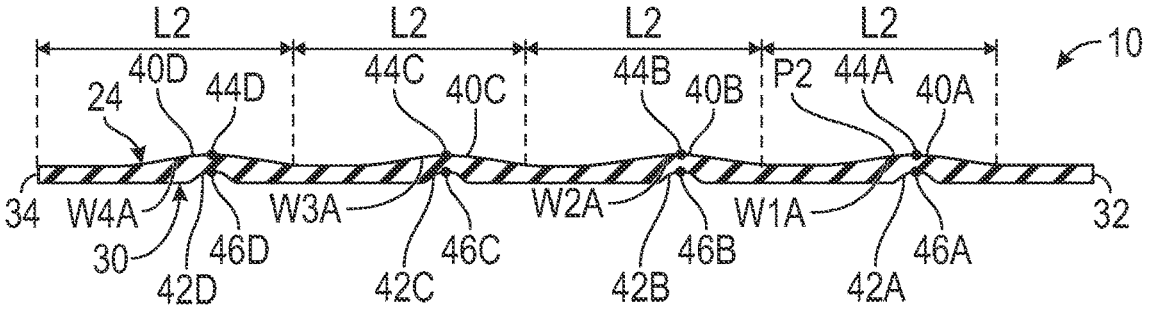
FIG. 7 is a schematic cross-sectional illustration of the sole plate of FIG. 1 taken at lines 7-7 in FIG. 1.
Figure 8:
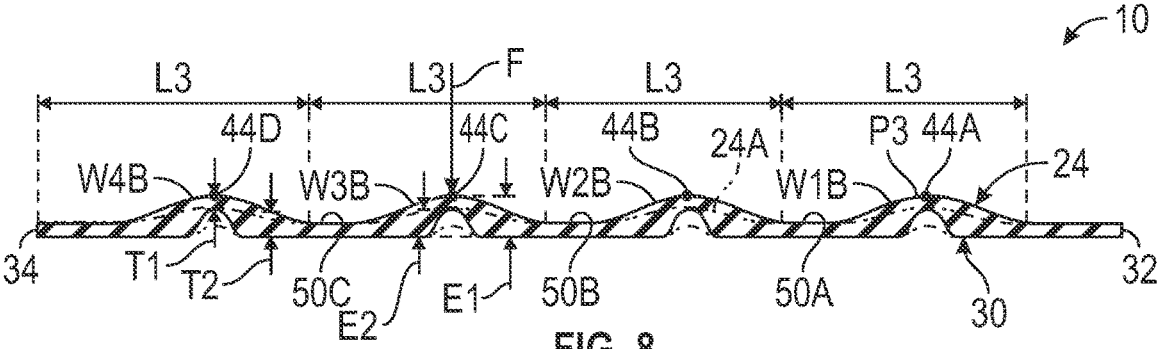
FIG. 8 is a schematic cross-sectional illustration of the sole plate of FIG. 1 taken at lines 8-8 in FIG. 1.
Figure 9:
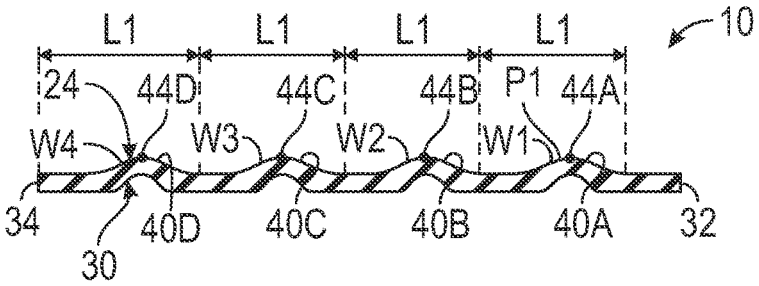
FIG. 9 is a schematic cross-sectional illustration of the sole plate of FIG. 1 taken at lines 9-9 in FIG. 1.
Figure 11:
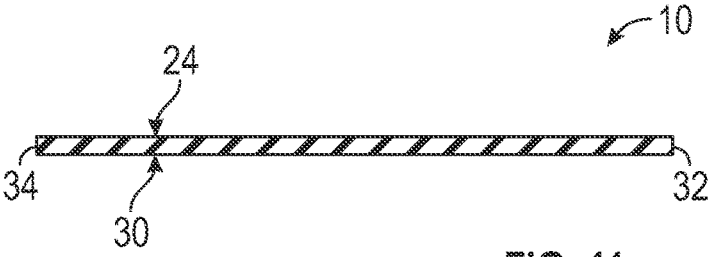
FIG. 11 is a schematic cross-sectional illustration of the sole plate of FIG. 1 taken at lines 11-11 in FIG. 1.

Referring to FIG. 1, the foot-facing surface 24 has ridges 40 extending longitudinally in the midfoot region 18 and in the forefoot region 16. The ridges 40 do not extend to the heel region 20. The foot-facing surface 24 is generally flat in the heel region 20 as best shown in FIGS. 10 and 11. The ground-facing surface 30 has grooves 42 extending longitudinally in correspondence with the ridges 40. In the embodiment shown, there are four ridges 40 and four grooves 42. More specifically, as best shown in FIGS. 7-9, there are four ridges 40A, 40B, 40C, 40D in order between the medial edge 32 and the lateral edge 34. The ridges 40A, 40B, 40C, 40D have crests 44A, 44B, 44C, 44D, respectively, that extend along the lengths of the respective ridges. A lateral-most one of the ridges 40D curves in the longitudinal direction to follow the curved lateral edge 34, and the medial-most one of the ridges 40A curves in the longitudinal direction to follow the curved medial edge 32. Stated differently, the ridge 40D curves relative to a longitudinal midline LM to generally follow the lateral edge 34, and the ridge 40A curves relative to the longitudinal midline LM to generally follow the medial edge 32. The longitudinal direction is generally a direction along a longitudinal midline LM of the sole plate 10, and may be either a forward direction (i.e., from the midfoot region 18 toward the forefoot region 16), or a rearward direction (i.e., from the forefoot region 16 toward the midfoot region 18).

Figure 3:
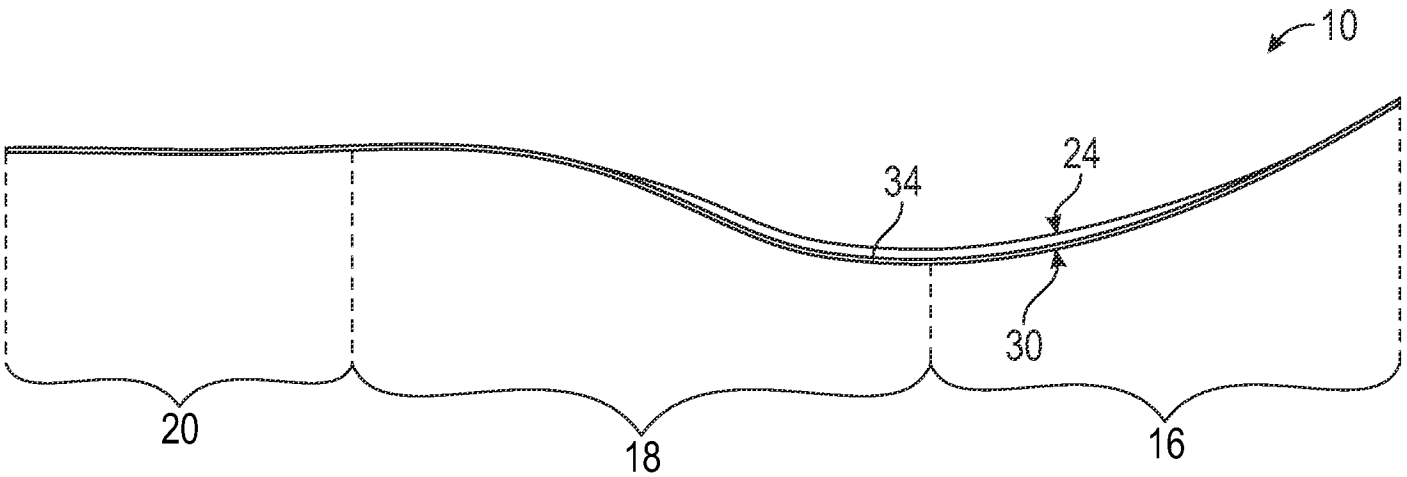
FIG. 3 is a schematic illustration in lateral side view of the sole plate of FIG. 1.
Figure 4:
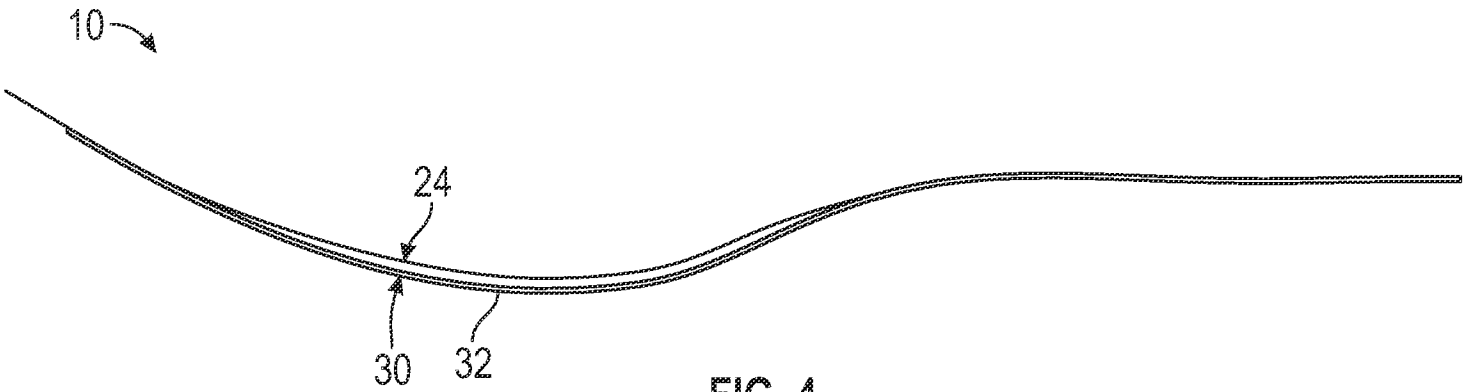
FIG. 4 is a schematic illustration in medial side view of the sole plate of FIG. 1.
Figure 5:
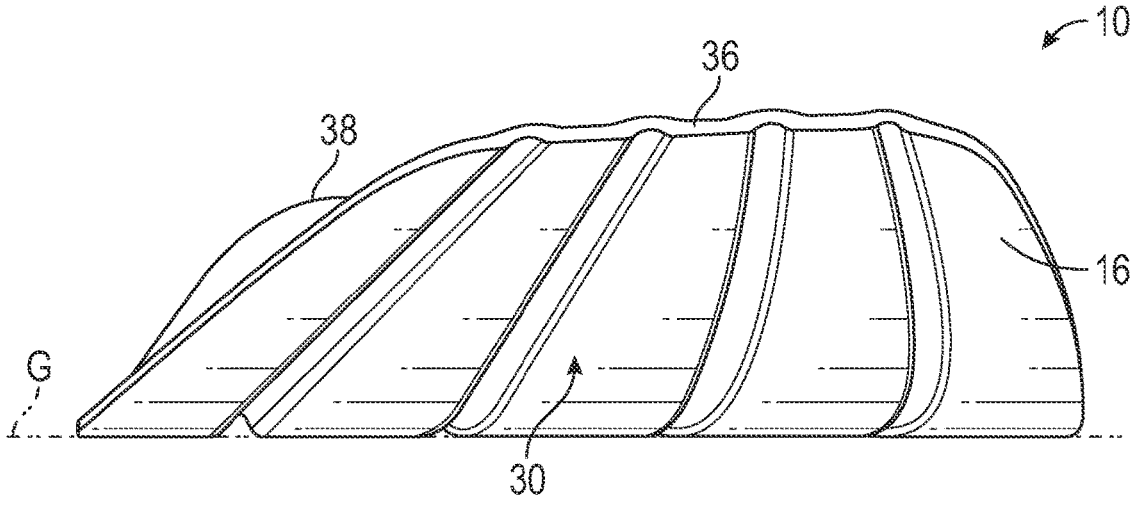
FIG. 5 is a schematic illustration in front view of the sole plate of FIG. 1.
Figure 6:
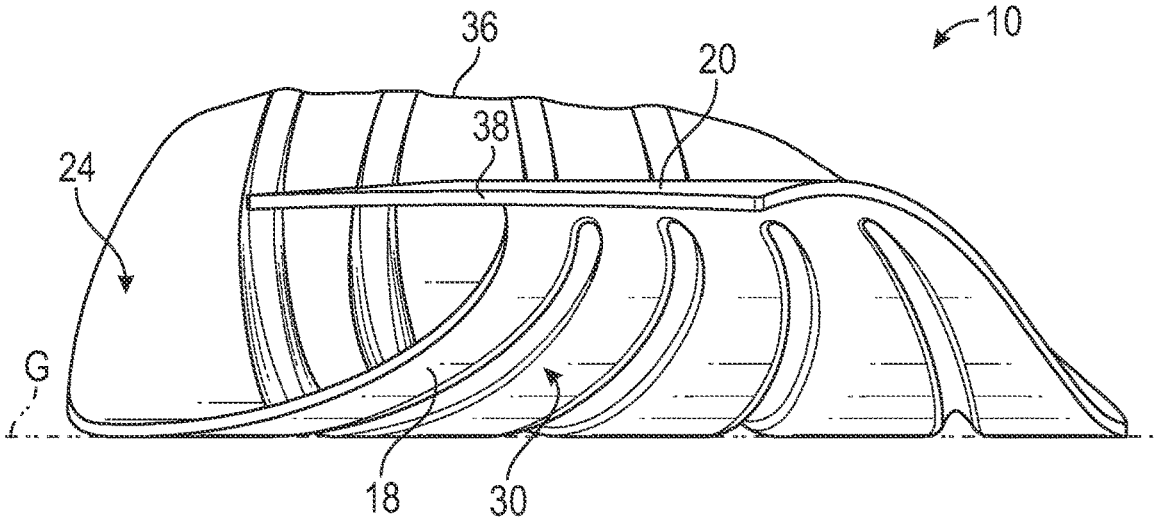
FIG. 6 is a schematic illustration in rear view of the sole plate of FIG. 1.
Figure 12:
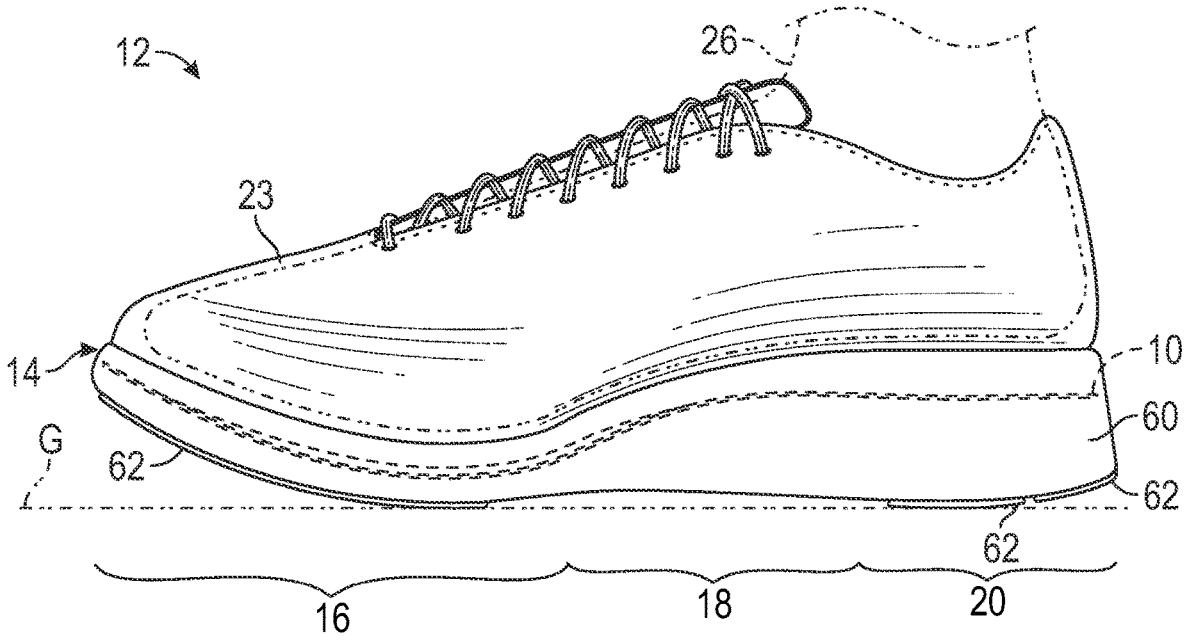
FIG. 12 is a schematic illustration in medial side view of an article of footwear having a sole structure that includes the sole plate of FIG. 1, with the sole plate shown in hidden lines.

With reference to FIGS. 3 and 4, the foot-facing surface 24 is concave in a longitudinal direction of the sole plate 10 in the forefoot region 16, and the ground-facing surface 30 is convex in the longitudinal direction of the sole plate 10 in the forefoot region 16. The concavity of the foot-facing surface 24 and the convexity of the ground-facing surface 30 extend into the midfoot region 18 so that the midfoot region 18 and the forefoot region 16 together establish a spoon shape. Additionally, the sole plate 10 slopes in the longitudinal direction in the midfoot region 18 from the heel region 20 to the forefoot region 16. More specifically, the midfoot region 18 slopes downward from the heel region 20 to the forefoot region 16 when the sole plate 10 is assembled in the sole structure 14 and the sole structure 14 rests on a level ground surface G as shown in FIG. 12. FIGS. 5 and 6 also illustrate the concavity of the foot-facing surface 24 and the convexity of the ground-facing surface 30 in the forefoot region 16. In FIGS. 5 and 6, the sole plate 10 is shown with the lowest point resting on a level ground surface G (i.e., prior to installation in the sole structure 14). The sole plate 10 slopes downward in the forefoot region 16 from a front edge 36. The sole plate 10 slopes down in the midfoot region 18 relative to the heel region 20 which is level with a rear edge 38. The front edge 36 is higher than the rear edge 38 when in this position.

As used herein, a transverse cross-section of the sole plate 10 through the ridges 40 is a cross-section perpendicular to the longitudinal midline LM, and includes the cross-sections of FIGS. 7-11. As best shown in FIGS. 7-9, at any particular transverse cross-section of the sole plate 10 through the ridges 40A, 40B, 40C, 40D, the crests 44A, 44B, 44C, 44D are equally spaced apart from one another. Stated differently, all adjacent crests 44A, 44B, 44C, 44D are equally-spaced. However, because the distance between the lateral edge 34 and the medial edge 32 varies along the length of the sole plate 10 (i.e., the sole plate 10 has different widths at different transverse cross-sections), the crests 44A, 44B, 44C, 44D extend non-parallel with one another in the longitudinal direction of the sole plate 10.

With reference to FIG. 2, there are four grooves 42A, 42B, 42C, 42D on the ground-facing surface 30, in order, between the medial edge 32 and the lateral edge 34. As is apparent in FIG. 2, the grooves 42A, 42B, 42C, 42D do not extend to the heel region 20, and the ground-facing surface 30 is generally flat in the heel region 20. The ridges 40 and the grooves 42 extend only in the midfoot region 18 and the forefoot region 16. The grooves 42A, 42B, 42C, 42D have crests 46A, 46B, 46C, 46D, respectively, that extend along the lengths of the respective grooves. A lateral-most one of the groove 42D curves in the longitudinal direction to follow the curved lateral edge 34, and the medial-most one of the grooves 42A curves in the longitudinal direction to follow the curved medial edge 32. Stated differently, the groove 42D curves relative to the longitudinal midline LM to generally follow the lateral edge 34, and the groove 42A curves relative to the longitudinal midline LM to follow the medial edge 32. Like crests 44A, 44B, 44C, 44D, at any transverse cross-section of the sole plate 10 through the ridges 40A, 40B, 40C, 40D, the crests 46A, 46B, 46C, 46D are equally spaced apart from one another (i.e., all adjacent crests 46A, 46B, 46C, 46D are equally-spaced) and the crests 46A, 46B, 46C, 46D extend non-parallel with one another in the longitudinal direction of the sole plate 10.

The crests 46A, 46B, 46C, 46D of the grooves 42A, 42B, 42C, 42D are aligned with crests 44A, 44B, 44C, 44D of the ridges 40A, 40B, 40C, 40D. As used herein, the crests 44A, 44B, 44C, 44D are aligned with the crests 46A, 46B, 46C, 46D because the crests directly underlie the crests 44A, 44B, 44C, 44D along the length of the ridge 40A, 40B, 40C, 40D so that a line connecting crests of a corresponding ridge and groove (e.g., a line connecting crest 44A and crest 46A) is perpendicular to a line along the flat portions of the ground-facing surface 30 at the transverse cross-section. As is apparent in FIGS. 1-2, and 5-9, the ground-facing surface 30 of the sole plate 10 is flat between the grooves 42 at any transverse cross-section.

Due to the ridges 40 and the grooves 42, the sole plate 10 has an undulating profile at any transverse cross-section of the sole plate 10 through the ridges 40. For example, the transverse cross-section of FIG. 9 is a first transverse cross-section of the sole plate 10 in the midfoot region 18. The foot-facing surface 24 has an undulating profile P1 of the sole plate at the first transverse cross-section. The undulating profile P1 includes a first set of multiple waves W1, W2, W3, W4 having crests 44A, 44B, 44C, 44D at the ridges 40A, 40B, 40C, 40D, and having troughs 50A, 50B, 50C between respective adjacent ones of the ridges. Each of the waves W1, W2, W3, W4 is of an equal wavelength first L1.

The transverse cross-section at FIG. 7 is a second transverse cross-section of the sole plate 10 through the ridge 40 in the forefoot region 16. The undulating profile P2 of the sole plate 10 at the second transverse cross-section includes a second set of multiple waves W1A, W2A, W3A, W4A having crests 44A, 44B, 44C, 44D at the ridges 40A, 40B, 40C, 40D, and having the troughs 50A, 50B, 50C between respective adjacent ones of the ridges. Each of the waves W1A, W2A, W3A, W4A is of an equal second wavelength L2. The second wavelength L2 is greater than the first wavelength L1 due to the greater width of the sole plate 10 (from the medial edge 32 to the lateral edge 34) at the second transverse cross-section.

A third transverse cross-section of the sole plate 10 across the ridges 40 is shown in FIG. 8 and is positioned longitudinally between the first and second cross-sections of FIGS. 9 and 7. The undulating profile P3 of the sole plate 10 at the third transverse cross-section includes a third set of multiple waves W1B, W2B, W3B, W4B having the crests 44A, 44B, 44C, 44D at the ridges 40A, 40B, 40C, 40D, and having the troughs 50A, 50B, 50C between respective adjacent ones of the ridges. Each of the waves W1B, W2B, W3B, W4B is of an equal third wavelength L3. The third wavelength L3 is greater than the first wavelength L1 and the second wavelength L2 due to the width of the sole plate 10 at the third transverse cross-section being greater than that at the first transverse cross-section and greater than that at the second transverse cross-section. Generally, increasing the number of ridges 40 over a given width (i.e., decreasing the wavelength) increases the bending stiffness in the longitudinal direction of the sole plate 10. The sole plate 10 is wider in the forefoot region 16 at the third transverse cross-section of FIG. 8 than in the midfoot region 18 at the first transverse cross-section of FIG. 9. Because the ridges 40 are nonparallel and the wavelengths of the waves at a given transverse cross-section are equal, the sole plate 10 has the same number of ridges (four) over the forefoot region 16 and midfoot region 18.

In addition to the number of ridges 40, the thickness of the sole plate 10 and the amplitude of the crests 44A, 44B, 44C, 44D affect the bending stiffness as well as the energy return of the sole plate 10. When the crests 44A, 44B, 44C, 44D are referred to generally herein, the reference numeral 44 may be used. The ridges 40 and the grooves 42 are configured such that a thickness of the sole plate 10 from the foot-facing surface 24 to the ground-facing surface 30 varies at a transverse cross-section of the sole plate 10 through the ridges 40 and varies along a length of at least one of the ridges 40. For example, as shown at the transverse cross-section in FIG. 8, the thickness T1 of the sole plate 10 at the crests 44 of the ridges 40 (as shown at crest 44D) is less than the thickness T2 of the sole plate 10 at a location between the crests of the ridges and the troughs. The sole plate 10 will thus tend to elastically deform under a dynamic compressive load applied to the foot-facing surface 24 beginning at the crests 44. For example, the sole plate 10 may be a resilient material such that the foot-facing surface 24 including the crests 44 of the ridges 40 decreases in elevation under a dynamic compressive load from the steady state elevation shown with solid lines in FIG. 8 to a loaded elevation 24A shown in phantom in FIG. 8, and returns to the steady state elevation upon removal of the dynamic compressive load. At the crest 44C, for example, the elevation decreases from elevation E1 to elevation E2. For example, the sole plate 10 may be a fiber strand-lain composite, a carbon-fiber composite, a thermoplastic elastomer, a glass-reinforced nylon, wood, steel, or combinations thereof.

The ability of and the degree to which the sole plate 10 elastically deforms is also tuned by varying the thickness of the sole plate 10 along the length of the ridges 40, and by varying the amplitude of the crests 44 along the length of the ridges 40. A comparison of the transverse cross-sections of FIGS. 7-11 shows that the sole plate 10 is thinnest (i.e., has the least thickness) at the ridges 40 where the amplitude of the crests 44 is the highest (e.g., in FIG. 8), and the thickens gradually at the crests 44 as the amplitude decreases, as can be seen in FIGS. 7 and 9.

The ability of and the degree to which the sole plate 10 elastically deforms is tuned by varying the thickness of the sole plate 10 along the length of the ridges 40, and by varying the amplitude of the crests 44 along the length of the ridges 40. When the crests 46A, 46B, 46C, 46D are referred to generally herein, the reference numeral 46 may be used. The amplitude of the crests 46 is greater in zones of the sole plate 10 configured for relatively high compressive loads than in zones of the sole plate 10 configured for relatively low compressive loads. For example, referring to FIG. 1, at least some of the crests 46 may have an amplitude that is greater in a rearward portion 16A of the forefoot region 16 (e.g., including at the transverse cross-section of FIG. 8) than in a forward portion 16B of the forefoot region (e.g., including at the transverse cross-section of FIG. 7), and greater in the rearward portion 16A of the forefoot region 16 than in the midfoot region 18 (e.g., including at the transverse cross-section of FIG. 9). The greater amplitude of the crests 46 enables greater energy absorption under sufficient dynamic loading as more elastic deformation can occur with a greater possible change in height of the crests 46 between a steady state elevation and a loaded elevation. In the embodiment of the sole plate 10, the amplitude of the crests 44 at any given transverse cross-section is uniform. Stated differently, each of the crests 44A, 44B, 44C, 44D has the same amplitude at the cross-section of FIG. 7, and has the same amplitude at the cross-section of FIG. 8 (although different from that at FIG. 7), and has the same amplitude at the cross-section of FIG. 9 (although different from that at FIGS. 7 and 8).

Referring to FIG. 12, the sole structure 14 includes a resilient foam midsole 60. The sole structure 14 also includes discrete outsole elements 62, or alternatively, could include a unitary outsole. The midsole 60 includes a first foam layer 60A secured to the foot-facing surface 24, and a second foam layer 60B secured to the ground-facing surface 30. The first and second foam layers 60A, 60B are separate components having different compressive stiffnesses. The first foam layer 60A may be more or less stiff than the second foam layer 60B. The first foam layer 60A and the second foam layer 60B may be the same material composition, with different densities to provide the different compressive stiffnesses, or may be different materials.

Figure 18:
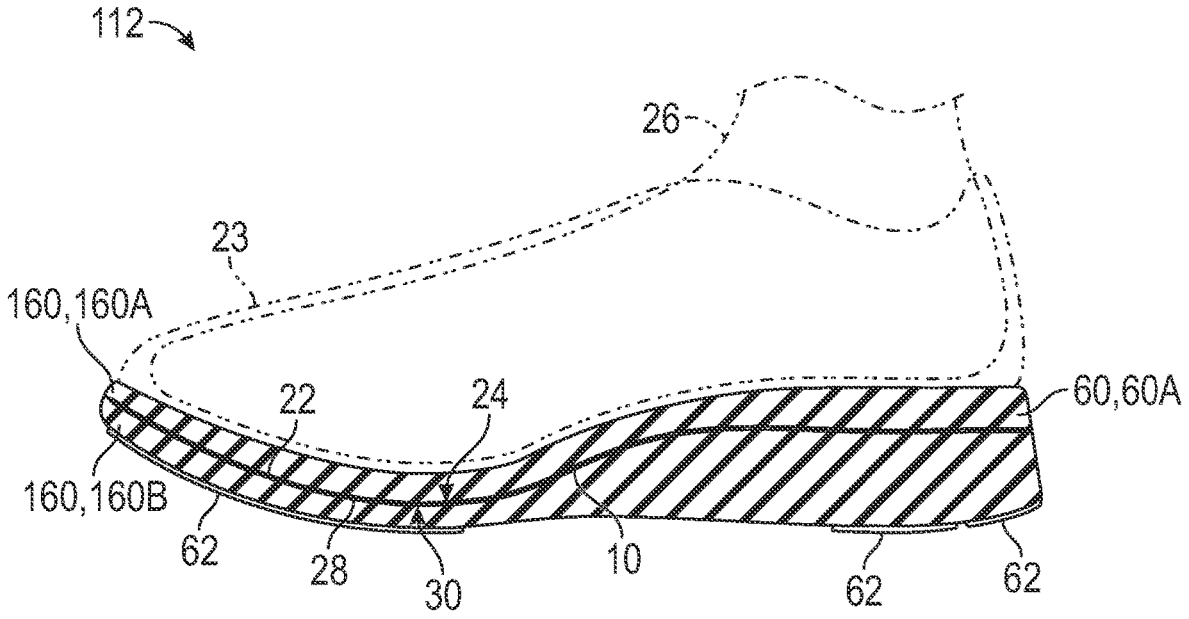
FIG. 18 is a schematic illustration in cross-sectional view of an alternative embodiment of an article of footwear with an alternative midsole system.

Alternatively, as shown in FIG. 18, an alternative article of footwear 112 has a midsole 160 that includes first and second foam layers 160A, 160B that are portions of a single component (i.e., a single, unitary, one-piece resilient foam midsole 160). The first and second resilient foam midsole layers 160A, 160B are an upper portion and a lower portion of a single resilient foam midsole 160 surrounding the sole plate 10, and in one embodiment, may be formed by injecting foam around the sole plate. The first and second foam layers 160A, 160B are the same material and have the same compressive stiffness.

Figure 17:
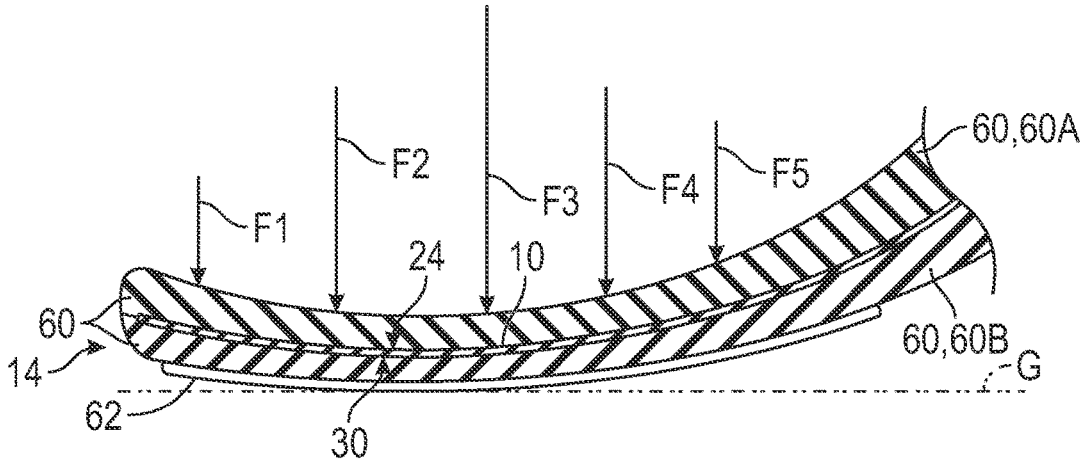
FIG. 17 is a schematic fragmentary cross-sectional illustration of a forefoot portion of the article of footwear of FIG. 16 when in the second stage of motion of FIG. 14.

As indicated in FIG. 17, the foam midsole 60 compresses between the foot 26 and the ground G under a dynamic compressive load and reacts against both the foot-facing surface 24 and the ground-facing surface 30 of the stiffer sole plate 10. The first foam layer 60A and the second foam layer 60B resiliently deform under the dynamic compressive load. The dynamic compressive load is illustrated by distributed loads F1, F2, F3, F4, F5 having various magnitudes represented by the length of the arrows. The first and second foam layers 60A, 60B return energy upon removal of the dynamic compressive load. Under dynamic loading, the first foam layer 60A is compressed against the foot-facing surface 24, and the second foam layer is compressed against the ground-facing surface 30.

Figure 13:
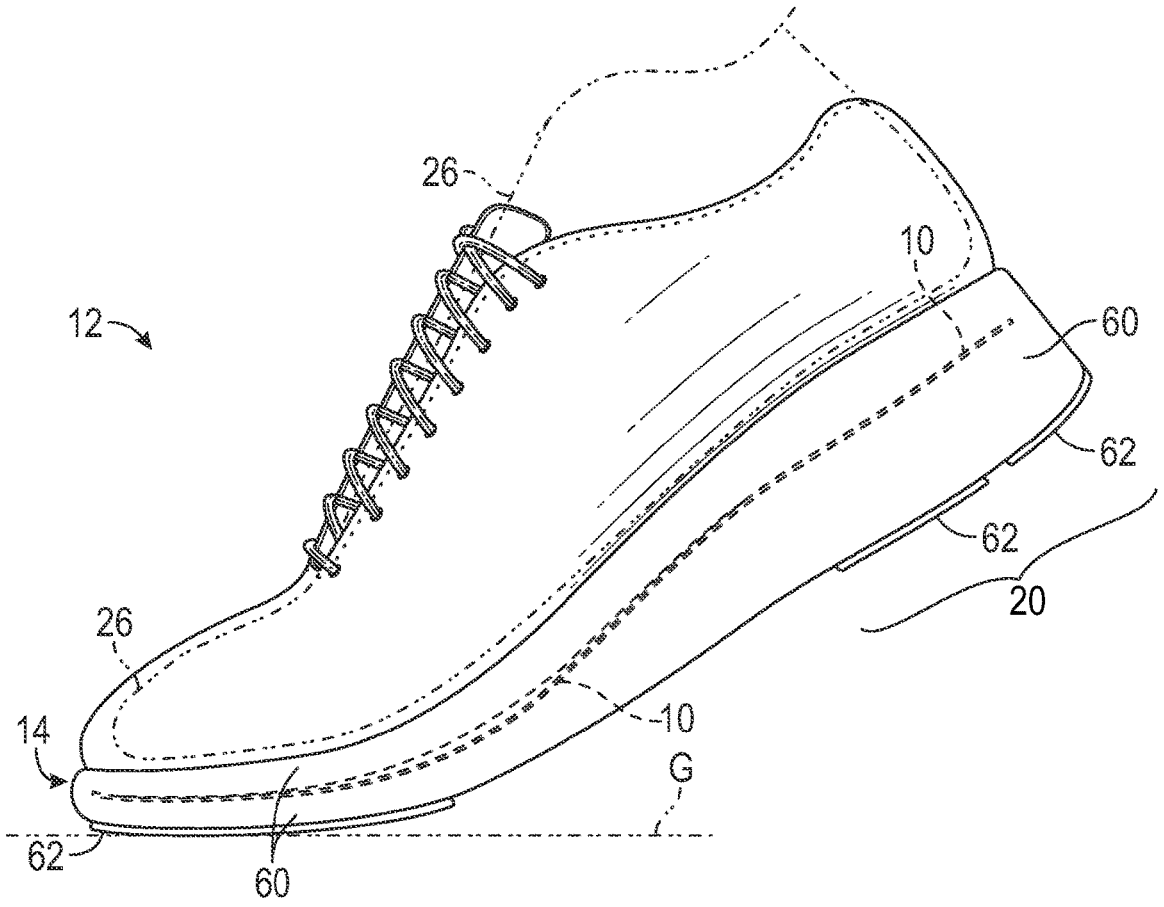
FIG. 13 is a schematic illustration in medial side view of the article of footwear of FIG. 12, in a first stage of motion.
Figure 14:
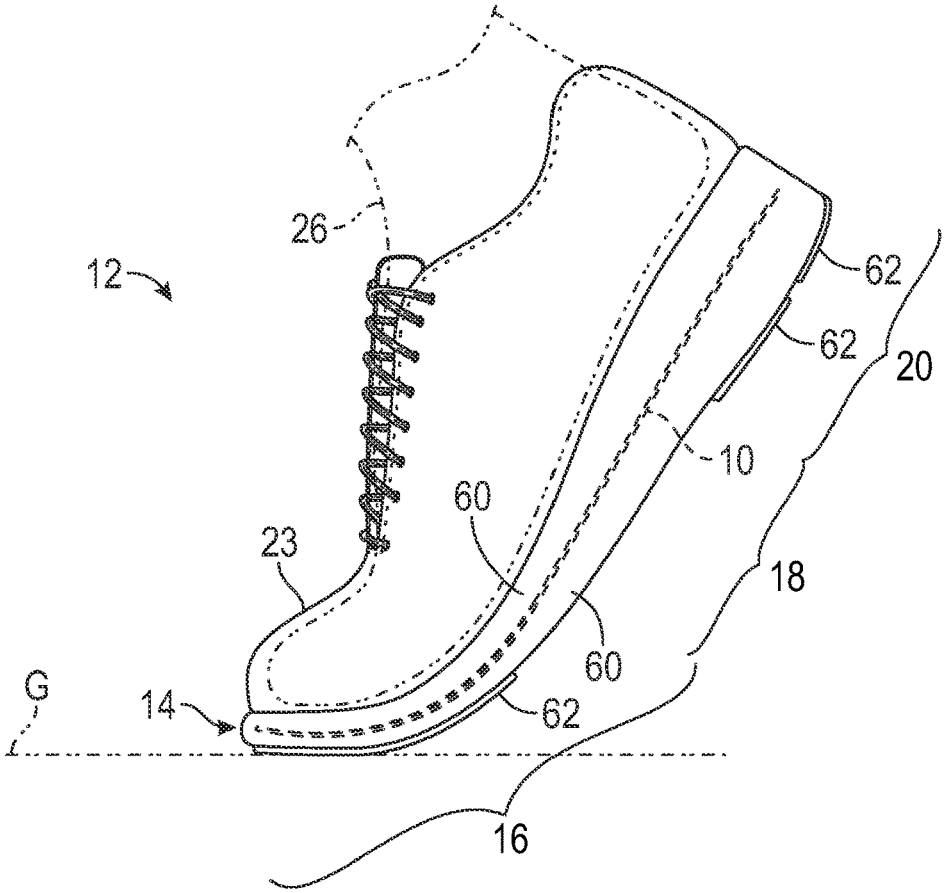
FIG. 14 is a schematic illustration in medial side view of the article of footwear of FIG. 12, in a second stage of motion.
Figure 15:
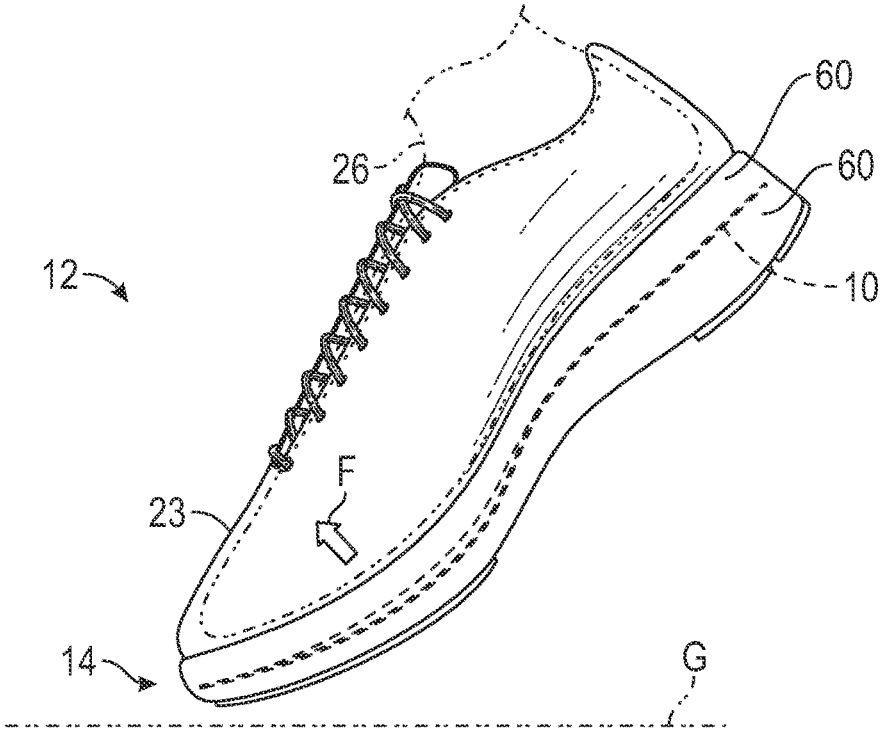
FIG. 15 is a schematic illustration in medial side view of the article of footwear of FIG. 12, in a third stage of motion.

FIG. 12 shows the article of footwear in a resting position, under steady state loading by the foot 26. FIG. 12 may also represent an interim position of the article of footwear 12 during a stride in which the sole structure 14 is flat on the ground G. FIGS. 13-15 show the article of footwear 12 in progressive first, second, and third stages of motion during the stride. The first stage of motion show in FIG. 13 is the beginning of the stride, with the heel portion 20 of the sole structure 14 and at least part of the midfoot portion 18 lifted from the ground G and the forefoot portion 16 in contact with the ground G. The second stage of motion in FIG. 14 shows further lifting of the midfoot portion 18 of the sole structure 14 away from the ground surface G and the forefoot portion 16 in contact with the ground G. Finally, FIG. 15 shows the article of footwear 12 completely lifted away from the ground G, as may occur during running. During the stride, the sole plate 10 bends along its length (e.g., along its longitudinal midline LM shown in FIG. 1). Progressive bending occurs in the forefoot region 16, generally under the metatarsal-phalangeal joints of the foot 26, when the foot 26 is dorsiflexed and increased loading is placed in the forefoot region 16 as the wearer's weight shifts to the forefoot.

Figure 16:
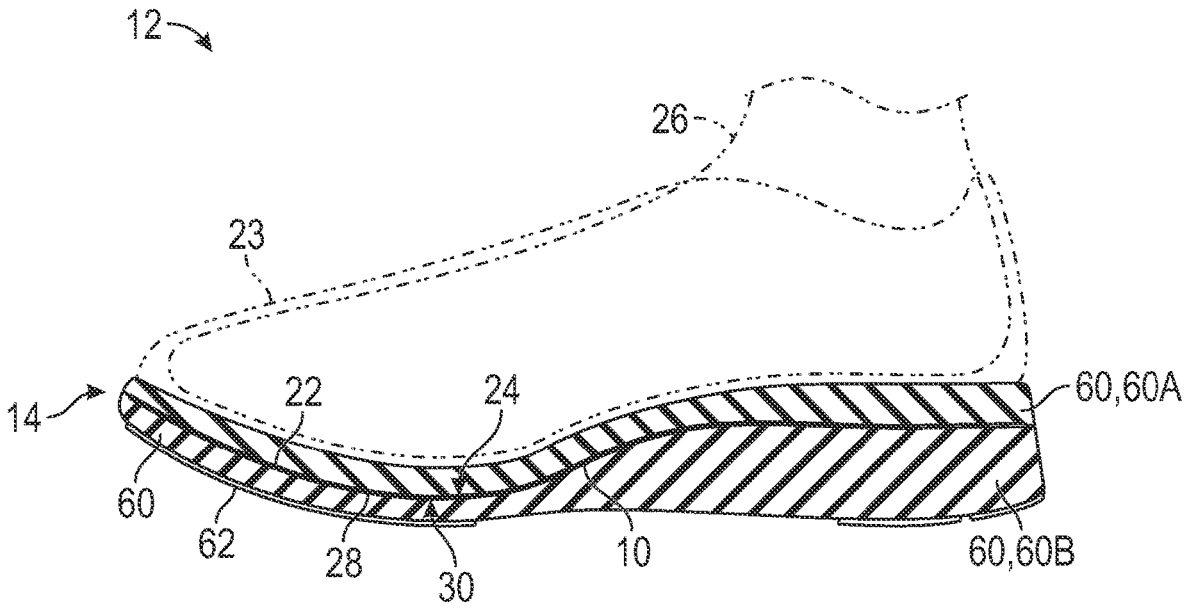
FIG. 16 is a schematic illustration in cross-sectional view of the article of footwear of FIG. 12 taken at lines 16-16 in FIG. 12.

The spoon shape of the sole plate 10, best shown in FIG. 16, including the concave foot-facing surface 24 and convex ground-facing surface 30 in the forefoot region 16 helps to encourage forward rolling of the foot 26. When the foot 26 lifts the sole structure 14 away from the ground Gin FIG. 15, the compressive forces in the sole plate 10 above a neutral axis of the sole plate 10 to the foot-facing surface 24, and tensile forces below the neutral axis to the ground-facing surface 30 are relieved, returning the sole plate 10 to its unloaded orientation shown in FIG. 15, which is the same as in FIG. 12 except lifted from the ground. The internal compressive and tensile forces in the sole plate 10 due to the wearer bending the sole plate 10 are released as the sole plate 10 unbends creates a net force F at least partially in the forward direction.

Accordingly, as discussed herein the sole plate 10 is tuned by varying its thickness, the amplitude of crests of ridges, and by the spoon shape, all of which contribute to the energy absorption during dynamic compression and longitudinal bending, and subsequent energy return during forward strides.

The following Clauses provide example configurations of a sole structure for an article of footwear disclosed herein.

Clause 1: A sole structure for an article of footwear comprising: a sole plate including a midfoot region, and the sole plate further including at least one of a forefoot region or a heel region; wherein the sole plate has a foot-facing surface with ridges extending longitudinally in the midfoot region and in the at least one of a forefoot region or a heel region; wherein the sole plate has a ground-facing surface with grooves extending longitudinally in correspondence with the ridges; and wherein the ridges and the grooves are configured such that a thickness of the sole plate from the foot-facing surface to the ground-facing surface varies at a transverse cross-section of the sole plate through the ridges, or varies along a length of at least one of the ridges, or varies at both the transverse cross-section and along the length of the at least one of the ridges.

Clause 2: The sole structure of Clause 1, wherein: the ridges have crests at least some of which extend non-parallel with one another in a longitudinal direction of the sole plate; and the grooves have crests at least some of which extend non-parallel with one another in the longitudinal direction.

Clause 3: The sole structure of any of Clauses 1-2, wherein the ridges have crests at least some of which vary in amplitude in a longitudinal direction of the sole plate such that the amplitude is greater in a zone of the sole plate configured for relatively high compressive loads than in a zone of the sole plate configured for relatively low compressive loads.

Clause 4: The sole structure of Clause 3, wherein: The sole plate includes the forefoot region; and at least some of the crests have an amplitude that is greater in a rearward portion of the forefoot region than in a forward portion of the forefoot region and, greater in the rearward portion of the forefoot region than in the midfoot region.

Clause 5: The sole structure of any of Clauses 1-4, wherein the ridges have crests, and the sole plate is a resilient material such that the crests of the ridges decrease in elevation from a steady state elevation to a loaded elevation under a dynamic compressive load and return to the steady state elevation upon removal of the dynamic compressive load.

Clause 6: The sole structure of Clause 5, wherein the sole plate is one of a fiber strand-lain composite, a carbon-fiber composite, a thermoplastic elastomer, a glass-reinforced nylon, wood, or steel.

Clause 7: The sole structure of any of Clauses 1-6, wherein: the sole plate includes the forefoot region; the foot-facing surface is concave in a longitudinal direction of the sole plate in the forefoot region; and the ground-facing surface is convex in the longitudinal direction of the sole plate in the forefoot region.

Clause 8: The sole structure of Clause 7, wherein: the sole plate includes the heel region; and the sole plate slopes in the longitudinal direction in the midfoot region from the heel region to the forefoot region.

Clause 9: The sole structure of any of Clauses 1-8, wherein: the foot-facing surface has an undulating profile at the transverse cross-section that includes multiple waves having crests at the ridges and having troughs between respective adjacent ones of the ridges; and the crests at the ridges are aligned with crests of the grooves.

Clause 10: The sole structure of Clause 9, wherein the thickness of the sole plate at the transverse cross-section is less at the crests of the ridges than between the crests of the ridges and the troughs.

Clause 11: The sole structure of any of Clauses 1-10, wherein: the sole plate includes both the forefoot region and the heel region; the ridges and the grooves extend only in the midfoot region and the forefoot region; and the sole plate has an undulating profile at any transverse cross-section of the sole plate through the ridges.

Clause 12: The sole structure of Clause 11, wherein: the transverse cross-section is a first transverse cross-section of the sole plate in the midfoot region; the undulating profile of the sole plate at the first transverse cross-section includes a first set of multiple waves having crests at the ridges and having troughs between respective adjacent ones of the ridges; the undulating profile of the sole plate at a second transverse cross-section in the forefoot region includes a second set of multiple waves having crests at the ridges and having troughs between respective adjacent ones of the ridges; waves of the first set each have a first wavelength; and waves of the second set each have a second wavelength greater than the first wavelength.

Clause 13: The sole structure of any of Clauses 1-12, wherein: a lateral-most one of the ridges curves in the longitudinal direction to follow a curved lateral edge of the sole plate; and a medial-most one of the ridges curves in the longitudinal direction to follow a curved medial edge of the sole plate.

Clause 14: The sole structure of Clause 1, wherein the ground-facing surface is flat between the grooves at the transverse cross-section.

Clause 15: The sole structure of any of Clauses 1-14, wherein the sole plate includes both the forefoot region and the heel region and is a unitary, one-piece component.

Clause 16: A sole structure for an article of footwear comprising: a sole plate including a midfoot region, a forefoot region, and a heel region; wherein the sole plate has a foot-facing surface with ridges extending longitudinally such that the foot-facing surface has an undulating profile at a transverse cross-section of the sole plate through the ridges; wherein the sole plate has a ground-facing surface with grooves extending longitudinally; wherein at least some of the ridges of the foot-facing surface extend non-parallel with one another, and at least some of the grooves of the ground-facing surface extend non-parallel with one another in correspondence with the ridges; wherein the ridges and the grooves are configured such that a thickness of the sole plate from the foot-facing surface to the ground-facing surface varies at the transverse cross-section, or varies along a length of at least one of the ridges, or varies at both the transverse cross-section and along the length of the at least one of the ridges; and at least some of the ridges vary in amplitude in a longitudinal direction of the sole plate.

Clause 17: The sole structure of Clause 16, wherein the amplitude of at least some of the ridges is greater in a rearward portion of the forefoot region than in a forward portion of the forefoot region, and greater in the rearward portion of the forefoot region than in the midfoot region.

Clause 18: The sole structure of any of Clauses 16-17, wherein the ridges have crests, and the sole plate is a resilient material such that the crests of the ridges decrease in elevation from a steady state elevation to a loaded elevation under a dynamic compressive load and return to the steady state elevation upon removal of the dynamic compressive load.

Clause 19: The sole structure of any of Clauses 17-18, wherein: the transverse cross-section is a first transverse cross-section of the sole plate in the midfoot region; the undulating profile of the sole plate at the first transverse cross-section includes a first set of multiple waves having crests at the ridges and having troughs between respective adjacent ones of the ridges; the undulating profile of the sole plate at a second transverse cross-section in the forefoot region includes a second set of multiple waves having crests at the ridges and having troughs between respective adjacent ones of the ridges; waves of the first set each have a first wavelength; waves of the second set each have a second wavelength greater than the first wavelength; a lateral-most one of the ridges curves in the longitudinal direction to follow a curved lateral edge of the sole plate; and a medial-most one of the ridges curves in the longitudinal direction to follow a curved medial edge of the sole plate.

Clause 20: The sole structure of any of Clauses 16-19, wherein: the foot-facing surface is concave in the longitudinal direction in the forefoot region; the ground-facing surface is convex in the longitudinal direction in the forefoot region; the sole plate slopes in the longitudinal direction in the midfoot region from the heel region to the forefoot region; and the ground-facing surface is flat between the grooves at the transverse cross-section.

To assist and clarify the subsequent description of various embodiments, various terms are defined herein. Unless otherwise indicated, the following definitions apply throughout this specification (including the claims).

"A", "an", "the", "at least one", and "one or more" are used interchangeably to indicate that at least one of the items is present. A plurality of such items may be present unless the context clearly indicates otherwise. As used herein, "at least some" of an item means at least two of the items. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives are employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal", as used throughout this detailed description and in the claims, refers to a direction extending a length of a component. For example, a longitudinal direction of a shoe extends between a forefoot region and a heel region of the shoe. The term "forward" is used to refer to the general direction from a heel region toward a forefoot region, and the term "rearward" is used to refer to the opposite direction, i.e., the direction from the forefoot region toward the heel region. In some cases, a component may be identified with a longitudinal axis as well as a forward and rearward longitudinal direction along that axis.

The term "vertical", as used throughout this detailed description and in the claims, refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to individual components of a sole structure. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, and may generally point towards the sole structure, or towards the outermost components of the sole structure.

The "interior" of an article of footwear, such as a shoe, refers to portions at the space that is occupied by a wearer's foot when the shoe is worn. The "inner side" of a component refers to the side or surface of the component that is (or will be) oriented toward the interior of the shoe in an assembled shoe. The "outer side" or "exterior" of a component refers to the side or surface of the component that is (or will be) oriented away from the interior of the shoe in an assembled shoe. In some cases, the inner side of a component may have other components between that inner side and the interior in the assembled shoe. Similarly, an outer side of a component may have other components between that outer side and the space external to the assembled shoe. Further, the terms "inward" and "inwardly" shall refer to the direction toward the interior of the component or article of footwear, such as a shoe, and the terms "outward" and "outwardly" shall refer to the direction toward the exterior of the component or article of footwear, such as the shoe. In addition, the term "proximal" refers to a direction that is nearer a center of a footwear component, or is closer toward a foot when the foot is inserted in the article as it is worn by a user. Likewise, the term "distal" refers to a relative position that is further away from a center of the footwear component or is further from a foot when the foot is inserted in the article as it is worn by a user. Thus, the terms proximal and distal may be understood to provide generally opposing terms to describe the relative spatial position of a footwear layer.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure for an article of footwear comprising:

a sole plate including a midfoot region and at least one of a forefoot region or a heel region;

wherein the sole plate has a foot-facing surface with ridges extending longitudinally in the midfoot region and in the at least one of a forefoot region or a heel region;

wherein the sole plate has a ground-facing surface with grooves extending longitudinally in correspondence with the ridges;

a foam midsole overlying and secured to the foot-facing surface and underlying and secured to the ground-facing surface; and wherein the ridges and the grooves are configured such that a thickness of the sole plate from the foot-facing surface to the ground-facing surface varies at a first transverse cross-section of the sole plate through the ridges in the midfoot region, or varies along a length of at least one of the ridges, or varies at both the first transverse cross-section and along the length of the at least one of the ridges.

2. The sole structure of claim 1, wherein the sole plate has an undulating profile at any transverse cross-section of the sole plate through the ridges.

3. The sole structure of claim 1, wherein:

an undulating profile of the sole plate at the first transverse cross-section includes a first set of multiple waves having crests at the ridges and having troughs between respective adjacent ones of the ridges;

an undulating profile of the sole plate at a second transverse cross-section in the forefoot region includes a second set of multiple waves having crests at the ridges and having troughs between respective adjacent ones of the ridges;

waves of the first set each have a first wavelength; and waves of the second set each have a second wavelength greater than the first wavelength.

4. The sole structure of claim 1, wherein the foam midsole includes a first foam layer secured to the foot-facing surface and a second foam layer secured to the ground-facing surface.

5. The sole structure of claim 4, wherein the first foam layer and the second foam layer are portions of an upper portion and a lower portion of a single, unitary, one-piece foam midsole.

6. The sole structure of claim 4, wherein the first foam layer and the second foam layer have one or more of different compressive stiffnesses, different material compositions, or different densities.

7. The sole structure of claim 1, wherein the sole plate includes both of a forefoot region and a heel region.

8. The sole structure of claim 7, wherein the ridges and the grooves extend only in the midfoot region and the forefoot region.

9. The sole structure of claim 1, wherein:

the ridges have crests at least some of which extend non-parallel with one another in a longitudinal direction of the sole plate; and the grooves have crests at least some of which extend non-parallel with one another in the longitudinal direction.

10. The sole structure of claim 9, wherein at least some of the crests vary in amplitude in a longitudinal direction of the sole plate such that the amplitude is greater in a zone of the sole plate configured for relatively high compressive loads than in a zone of the sole plate configured for relatively low compressive loads.

11. The sole structure of claim 9, wherein:

the sole plate includes a forefoot region; and at least some of the crests have an amplitude that is greater in a rearward portion of the forefoot region than in a forward portion of the forefoot region, and greater in the rearward portion of the forefoot region than in the midfoot region.

12. The sole structure of claim 9, wherein the sole plate is a resilient material such that the crests of the ridges decrease in elevation from a steady state elevation to a loaded elevation under a dynamic compressive load and return to the steady state elevation upon removal of the dynamic compressive load.

13. The sole structure of claim 12, wherein the sole plate is one of a fiber strand-lain composite, a carbon-fiber composite, a thermoplastic elastomer, a glass-reinforced nylon, wood, or steel.

14. The sole structure of claim 1, wherein:

the sole plate includes a forefoot region;

the foot-facing surface is concave in a longitudinal direction of the sole plate in the forefoot region; and the ground-facing surface is convex in the longitudinal direction of the sole plate in the forefoot region.

15. The sole structure of claim 1, wherein:

the sole plate includes both of a forefoot region and a heel region; and the sole plate slopes in the longitudinal direction in the midfoot region from the heel region to the forefoot region.

16. The sole structure of claim 1, wherein:

the foot-facing surface has an undulating profile at the first transverse cross-section that includes multiple waves having crests at the ridges and having troughs between respective adjacent ones of the ridges; and the crests at the ridges are aligned with crests of the grooves.

17. The sole structure of claim 16, wherein the thickness of the sole plate at the first transverse cross-section is less at the crests of the ridges than between the crests of the ridges and the troughs.

18. The sole structure of claim 1, wherein:

a lateral-most one of the ridges curves in the longitudinal direction to follow a curved lateral edge of the sole plate; and a medial-most one of the ridges curves in the longitudinal direction to follow a curved medial edge of the sole plate.

19. The sole structure of claim 1, wherein the ground-facing surface is flat between the grooves at the first transverse cross-section.

20. The sole structure of claim 1, wherein the sole plate is a unitary, one-piece component.

* * * * *